US005597227A

United States Patent [19]

Bergen et al.

[11] Patent Number: 5,597,227

[45] Date of Patent: Jan. 28, 1997

[54] ILLUMINATED DOOR LOCK

[75] Inventors: Gary R. Bergen, Yorba Linda; George E. Maffey, Dana Point, both of Calif.

[73] Assignee: Emhart Inc., Newark, Del.

[21] Appl. No.: 514,512

[22] Filed: Aug. 11, 1995

[51] Int. Cl.[6] ..... E05B 17/10

[52] U.S. Cl. ..... 362/100; 362/32

[58] Field of Search ..... 362/32, 100, 234, 362/253

[56] References Cited

U.S. PATENT DOCUMENTS 3,719,821 3/1973 Foreman ..... 362/100

5,398,175 3/1995 Pea ..... 362/100

*Primary Examiner*—Stephen F. Husar

*Attorney, Agent, or Firm*—Spencer Smith

[57] ABSTRACT

A door lock assembly to be secured within a horizontally extending through hole in a door which can have from a minimum to a maximum thickness, comprising an exterior lock assembly including a plug having a key receiving opening, an exterior rose liner, light pipe means for illuminating the key receiving opening, including a rod shaped portion secured to the exterior rose liner and extending axially inwardly for receiving light, and tubular housing means for receiving the axially extending rod shaped portion. The tubular housing means has a length corresponding to the length of the axially extending rod shaped portion, an interior lock assembly including an interior rose liner and means for transmitting light including a light source for transmitting light axially. The light transmitting means is supported by the interior rose assembly so that when the door lock assembly is secured within a door having a maximum thickness the light transmitting means will be axially spaced from the rod shaped portion by a distance at least equal to the difference between the minimum and maximum door thickness.

3 Claims, 9 Drawing Sheets

ILLUMINATED DOOR LOCK

The present invention relates to locksets for securing the door of a building such as a home, and more particularly, to such locksets which are illuminated prior to key entry.

There have been numerous designs to provide a light which will illuminate the keyhole of a lockset prior to entry. Recent patents in this area include U.S. Pat. Nos. 5,398,175, 5,179,325, 5,057,957, 4,777,570, 4,467,402, 4,310,873, 4,234,909, 4,078,248, and 3,955,075.

Since part of the lockset is stationary (the housing which is secured to a door) and part of the lockset is rotatable (the knobs/levers), establishing the required connections has proven difficult.

It is accordingly an object of the present invention to provide an improved lockset which can illuminate the keyhole prior to key insertion.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
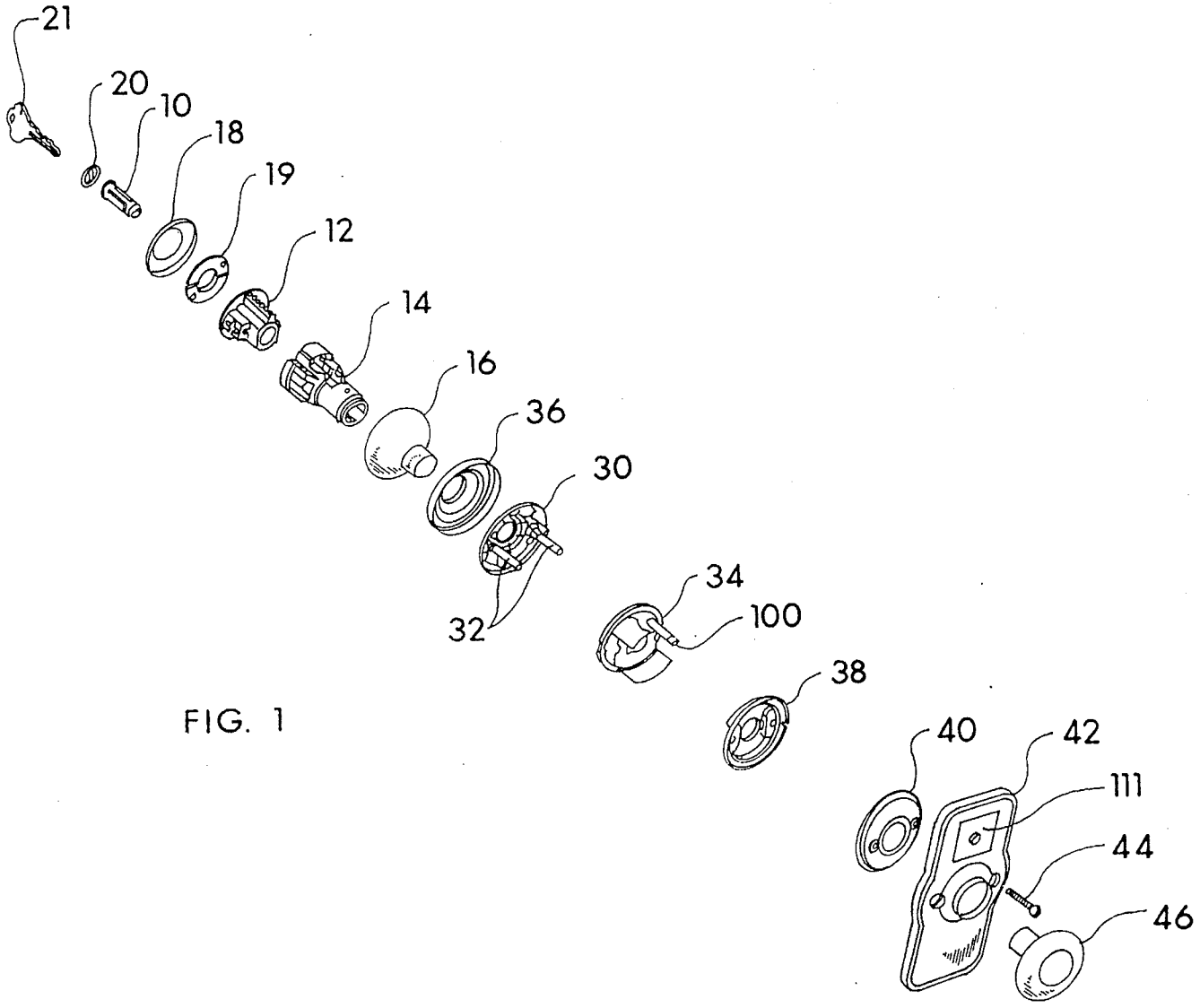
FIG. 1 is an oblique view of some of the parts of the lockset assembly made in accordance with the teachings of the present invention shown separated for clarity.

In a lockset the exterior operator assembly includes a key plug 10 inserted into a cylinder body 12 which is received by an insert 14 inserted into an exterior operator 16 (shown as a knob). The end of the cylinder is decorated with a cover 18 which captures an annular portion 19 made of clear plastic and the end of the plug 10 is decorated with another cover 20. To unlock this cylinder, a suitable key 21 is inserted into the plug.

The exterior operator assembly is connected to a conventional spindle assembly (not shown) which operates a conventional latch assembly (also not shown). Rotation of the operator accordingly operates the latch to open the door.

Figure 2:
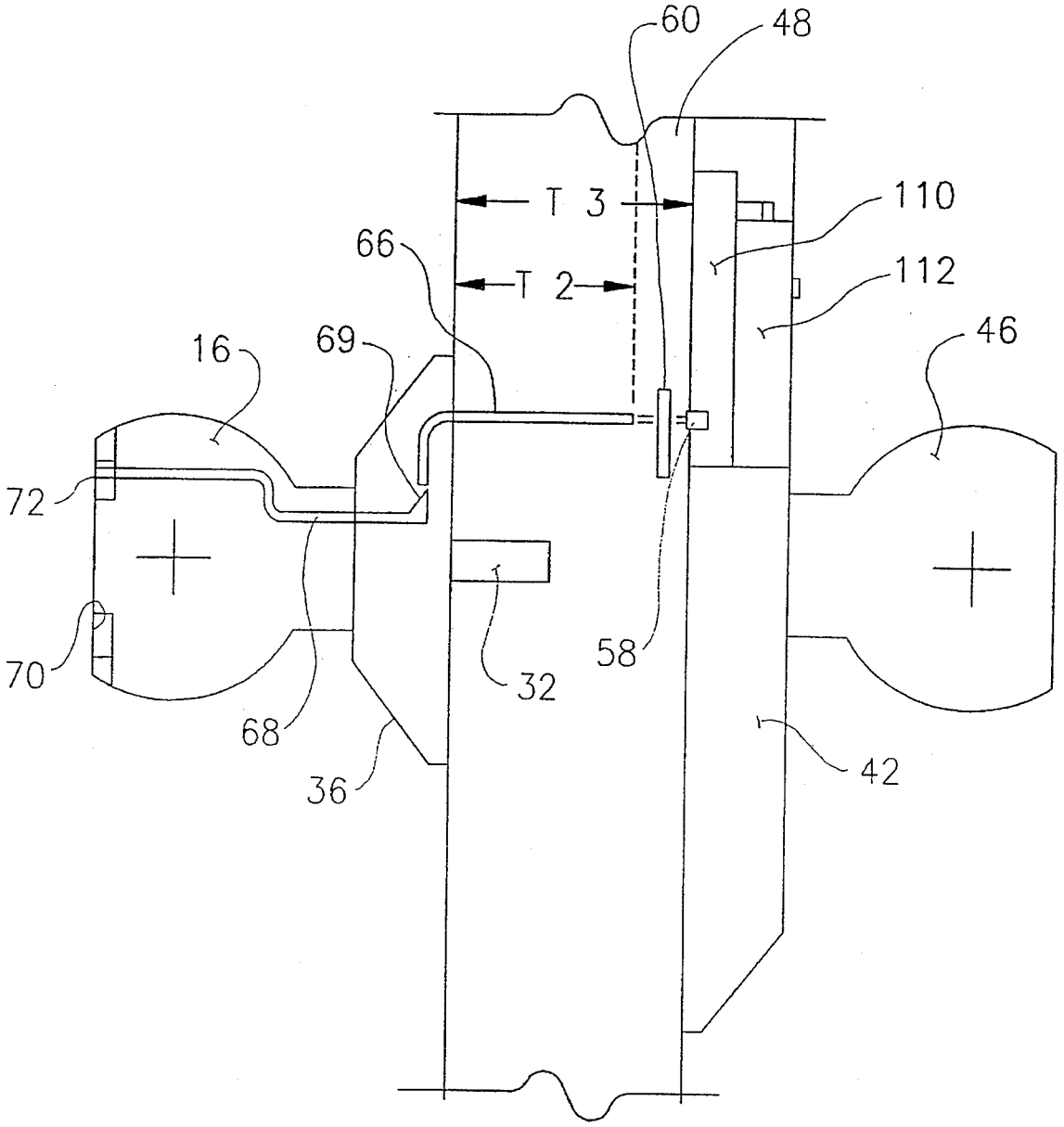
FIG. 2 is a schematic representation illustrating the lockset assembly secured to a door.

Secured to the door is a support assembly which is secured to and extends through the door. This support assembly includes the exterior rose liner 30 which has a pair of fastener receiving stems 32, a cylindrical shield 34 which slides onto the stems and locates against the rose liner and a rose cover 36 to dress the rose liner 30. The support assembly also includes an interior cover 38, an interior rose liner 40 and a cover 42 (the latter two could be one piece). The interior cover 38, the rose liner 40 and interior cover 42 have a pair of holes through which screws 44 can pass to enter the stems 32 on the exterior rose liner 30 to clamp the support assembly to a door 48 (FIG. 2). The spindle assembly interconnects the exterior 16 and interior 46 operators.

As shown in FIG. 2, the lockset is secured to a door 48 of a building like a residence or business, which can have a thickness which can vary from thickness T1 to thickness T2. The light source which may be an L.E.D. 58 is secured within the interior rose and will be operated for a set time (x minutes) before a person arrives at the door. The time will be selected to give the person enough time to open the door. The emitted light, which optionally can be further focused by a suitable lens 60 is transmitted to an exterior rod shaped light pipe assembly which is made from clear plastic and which includes a stationary rod shaped portion 66, a rod shaped portion 68 which is part of the exterior knob assembly and the annular portion 19 which emits light from its front annular flat surface 72. The input end 69 of the rod shaped portion 68 may be inclined by an angle of 45° to increase the amount of light received.

Figure 3:
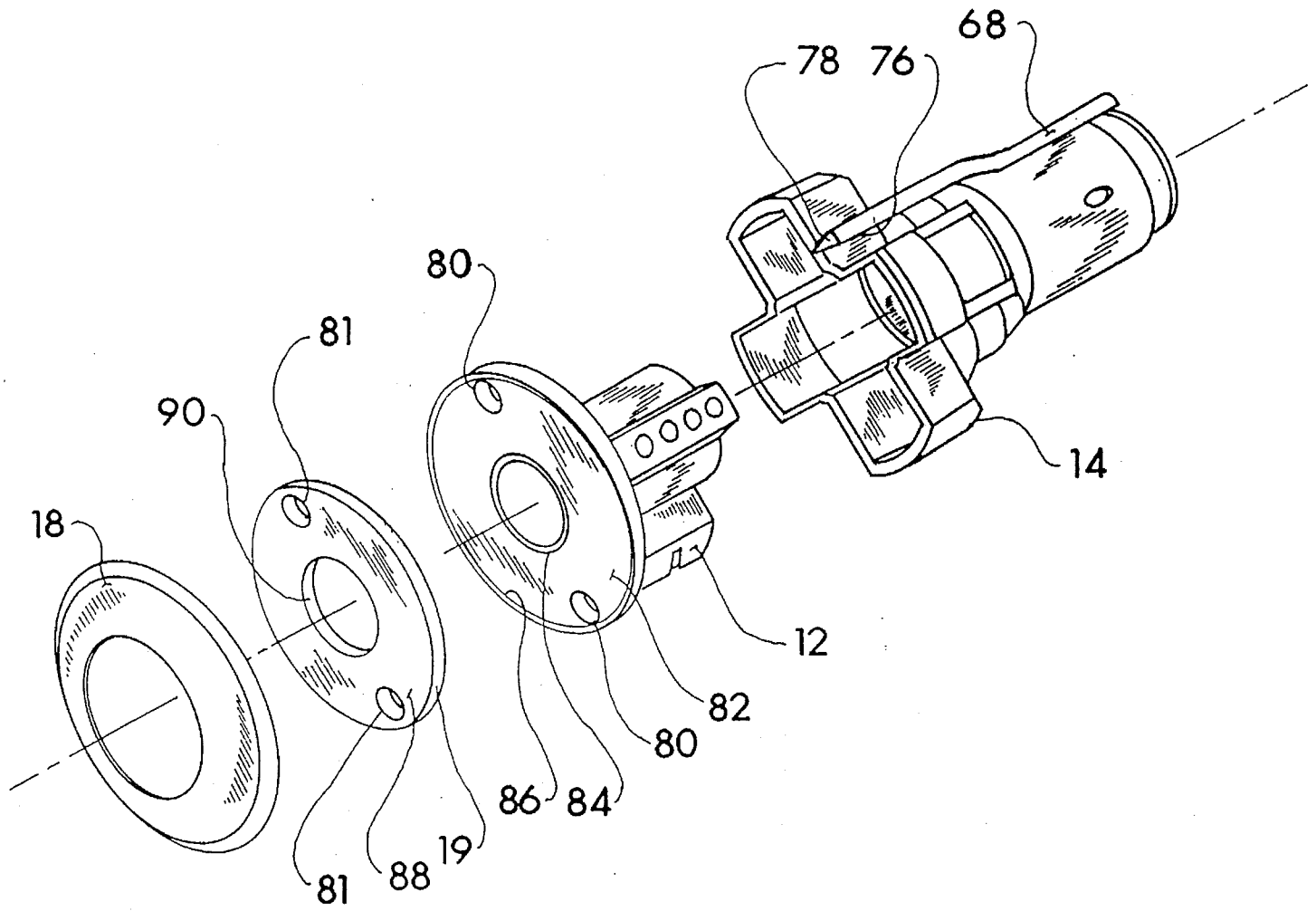
FIG. 3 is an oblique view of a portion of the structure shown in FIG. 1 separated for clarity.

As can be seen from FIG. 3, the front end of the stationary portion of the exterior light pipe assembly 68, is captured within a suitably shaped notch 76 at the top of the insert and projects a short distance beyond the top of the insert terminating with a 45° surface 78 facing tangentially. The projecting end 78 of the light pipe 68 passes through a hole 80 in the end face 82 of the insert 12 and enters into a hole 81 in the transparent annular portion 19 which is located on the end of the end face between an inner annular post 84 and an outer annular flange 86. The 45° inclined surface on the light pipe maximizes light transmission to the annular portion 19. The outer surface of this annular portion 19 has an annular outside recess 88 to receive the cylinder cover 18 thereby defining with the cover a smooth exterior surface including the cover and an exposed inner annular visible ring 90 of the annular portion 19. Optionally, the annular portion 19 can have all of its non exposed surfaces painted or colored white to maximize the amount of light that will leave through the annular exterior visible ring 90. As can be seen from FIG. 5, the other (inner) end of the rod shaped light pipe 68 is located within a slot 92 in the insert 12. When the exterior knob 16 is placed over the insert, the knob will fully capture both ends of this light pipe.

The exterior stationary light pipe 66 extends within and axially from the end of a third tubular housing or stem 100 which is fabricated as a part of the cylindrical shield (this stem could alternately be part of the exterior rose liner), through the exterior rose liner 30 to its exterior face 62, where it bends almost 90° and is partially captured within a U-shaped slot 102 (half shown) on the face. When the rose cover 36 is secured in place, the partially captured outer end of the stationary exterior light pipe 66 will be fully captured.

Figure 4:
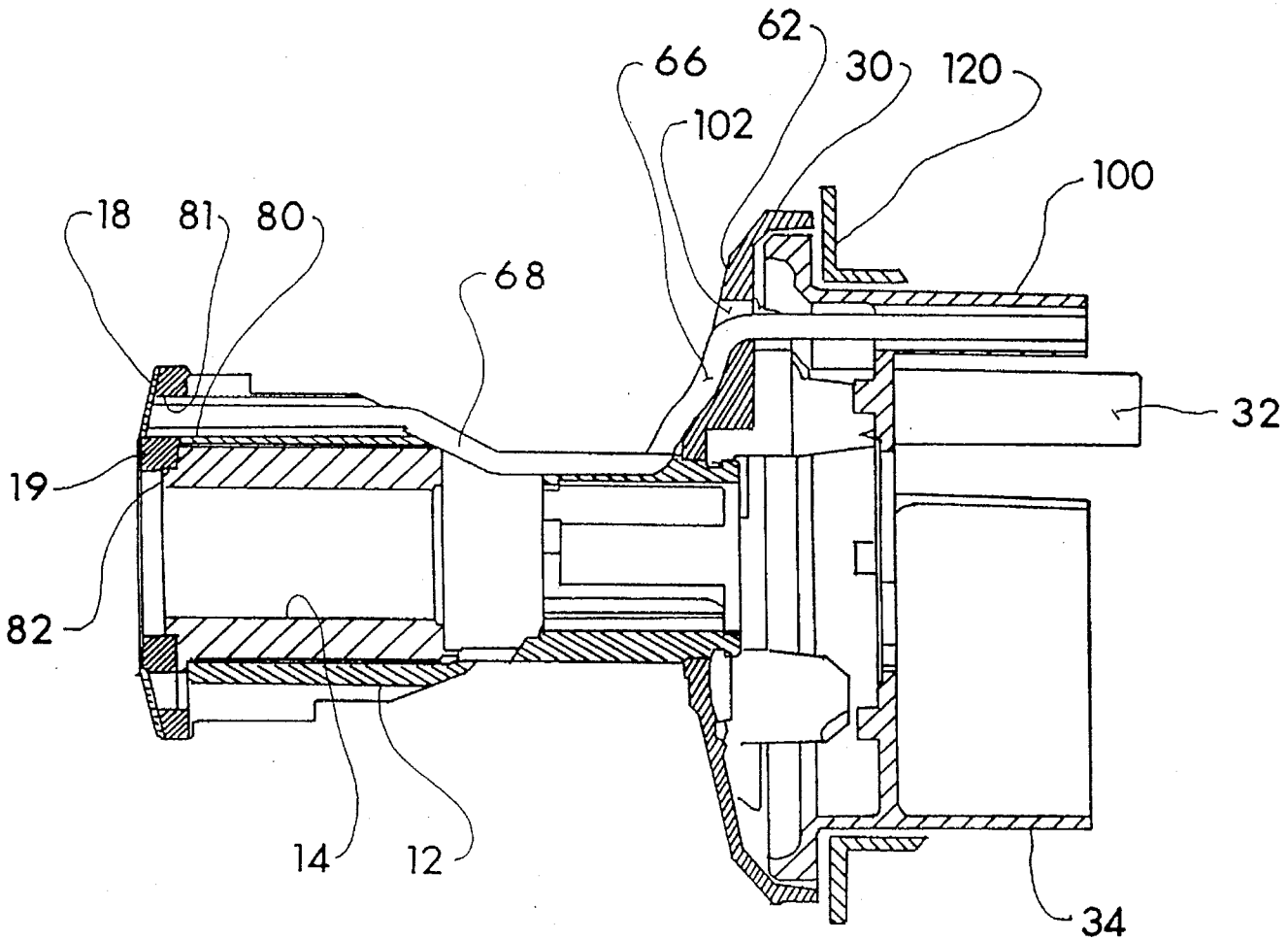
FIG. 4 is a side elevational view of the assembled exterior rose cover and insert with the parts in their normal orientations.
Figure 5:
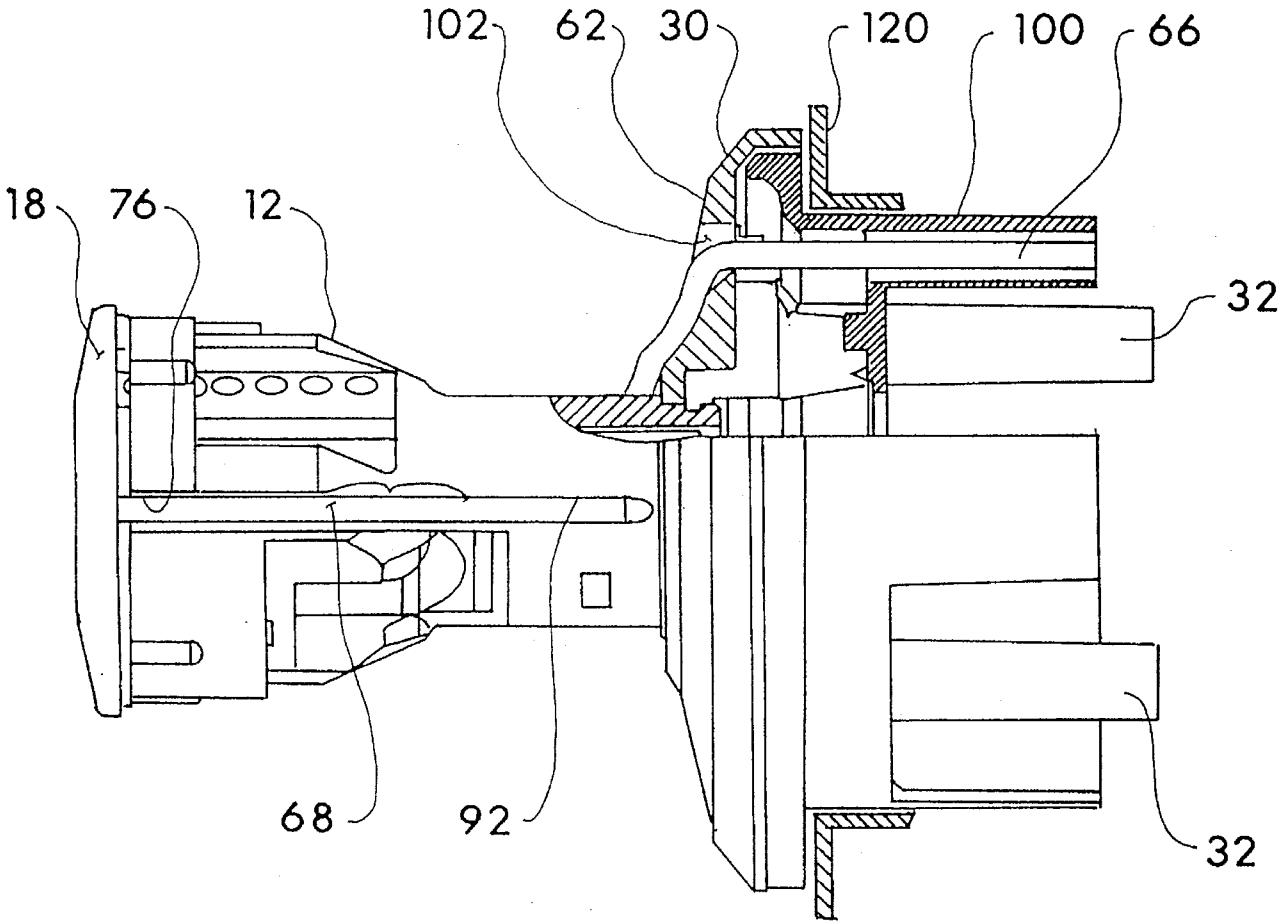
FIG. 5 is a view similar to that of FIG. 4 with the insert rotated relative to the rose cover, to the door open position.

FIG. 5, which is similar to FIG. 4, shows the insert rotated to the door open orientation. As can be seen from FIG. 5, when the operator is rotated to turn the insert to this position, a discontinuity will exist in the exterior light pipe assembly. The end of the stationary light pipe 66 will no longer see the light being transmitted from the inner end of the normally associated light pipe 68.

The L.E.D. 58 is secured to the receiver housing 110 (FIG. 2) which is secured to the interior cover 42 (an access door 111 may be provided). The receiver and the L.E.D. are powered by a battery 112 which is also located within this cover.

Figure 6:
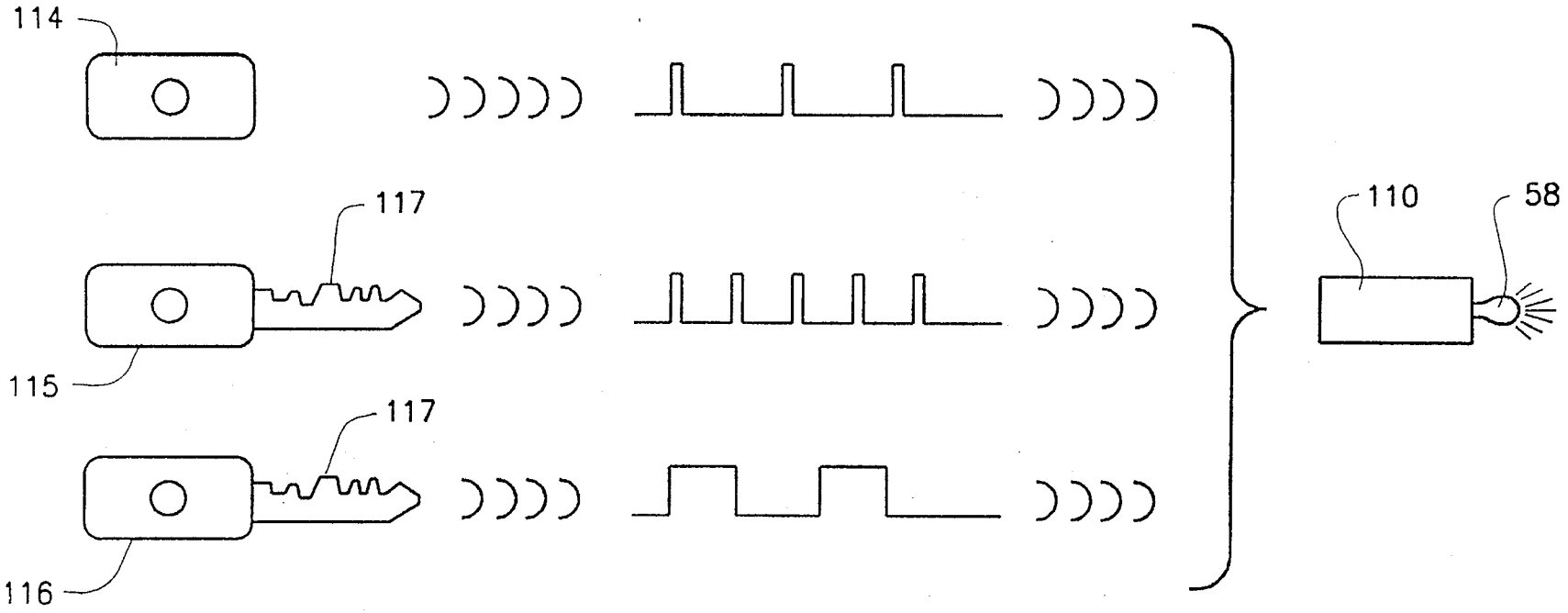
FIG. 6 is a schematic representation of the operation of light operating structure made in accordance with the teachings of the present invention.

FIG. 6 shows three RF transmitters 114, 115, 116. For example, transmitter 114 might be a garage door opener which would not have a key portion. Transmitter 115 might be a transmitter sold with the lockset assembly having a key portion for opening the lock and transmitter 116 might be a transmitter owned by a car owner for operating an alarm system, etc., which could have a key portion for opening the car door.

While the garage door opener and the car transmitter have an output signal having a permanent code, the lockset transmitter does not have a permanent code but rather issues a pulse train. As shown in FIG. 6, these three signals are different, i.e., only the garage door transmitter can open the garage door, and only the car transmitter can open the car door. Any of these signals, when received by the receiver, will operate the L.E.D. 58.

Figure 7:
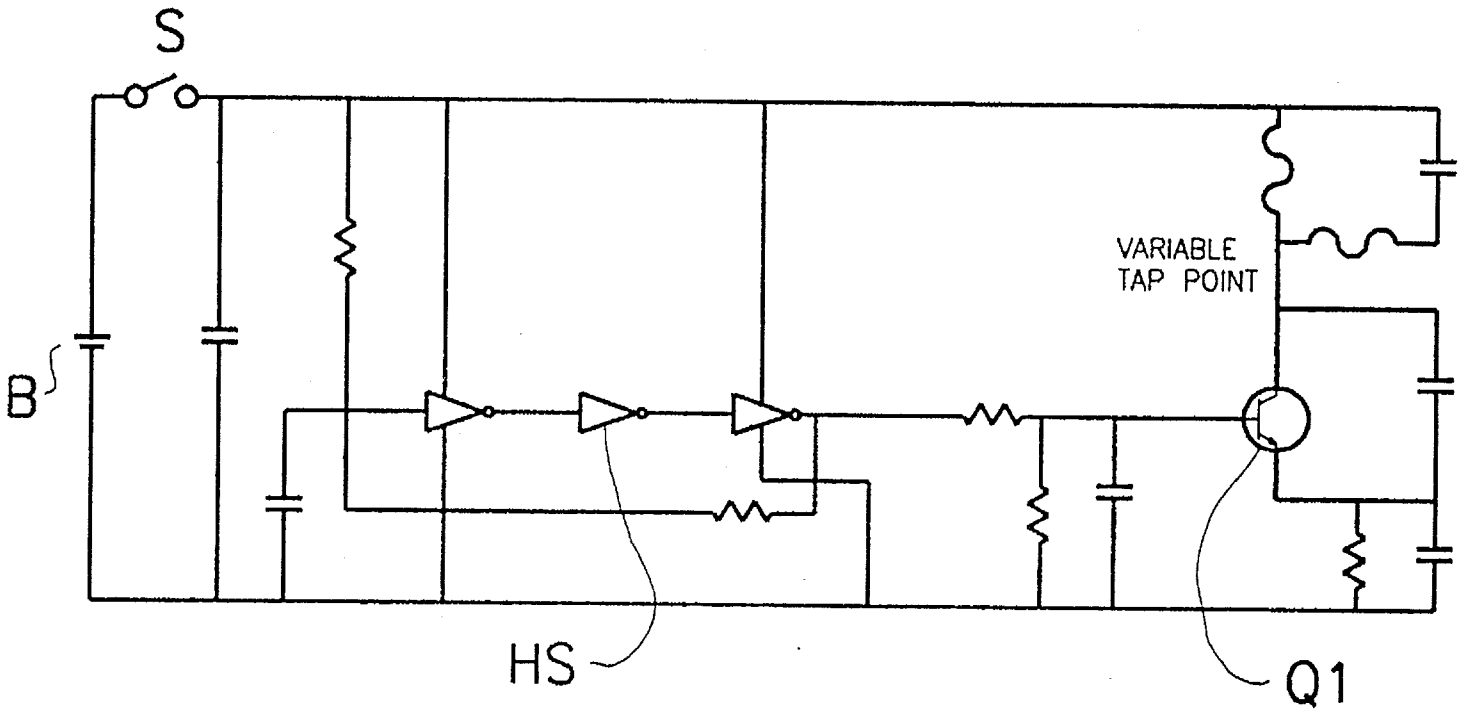
FIG. 7 is an electronic diagram of the transmitter of the system.

FIG. 7 illustrates the transmitter circuit in the lockset key. When a person depresses the button or switch S, the battery B operates a Hex Schmitt inverter HS which drives an RF transistor Q1 to transmit a signal in the form of a pulse train which conforms to FCC regulations (§15.231). These regulations encourage designers to use a relatively low duty cycle in transmitted pulses. Generally, a reasonable range of "on" pulse times is in the range of 0.1 to 0.8 millisecond and the "off" time should be in the range of 1 to 4 milliseconds. Such a pulse train is not a coded signal since in a coded signal, the duration of an "on" pulse can be varied to convey digital information.

Figure 8:
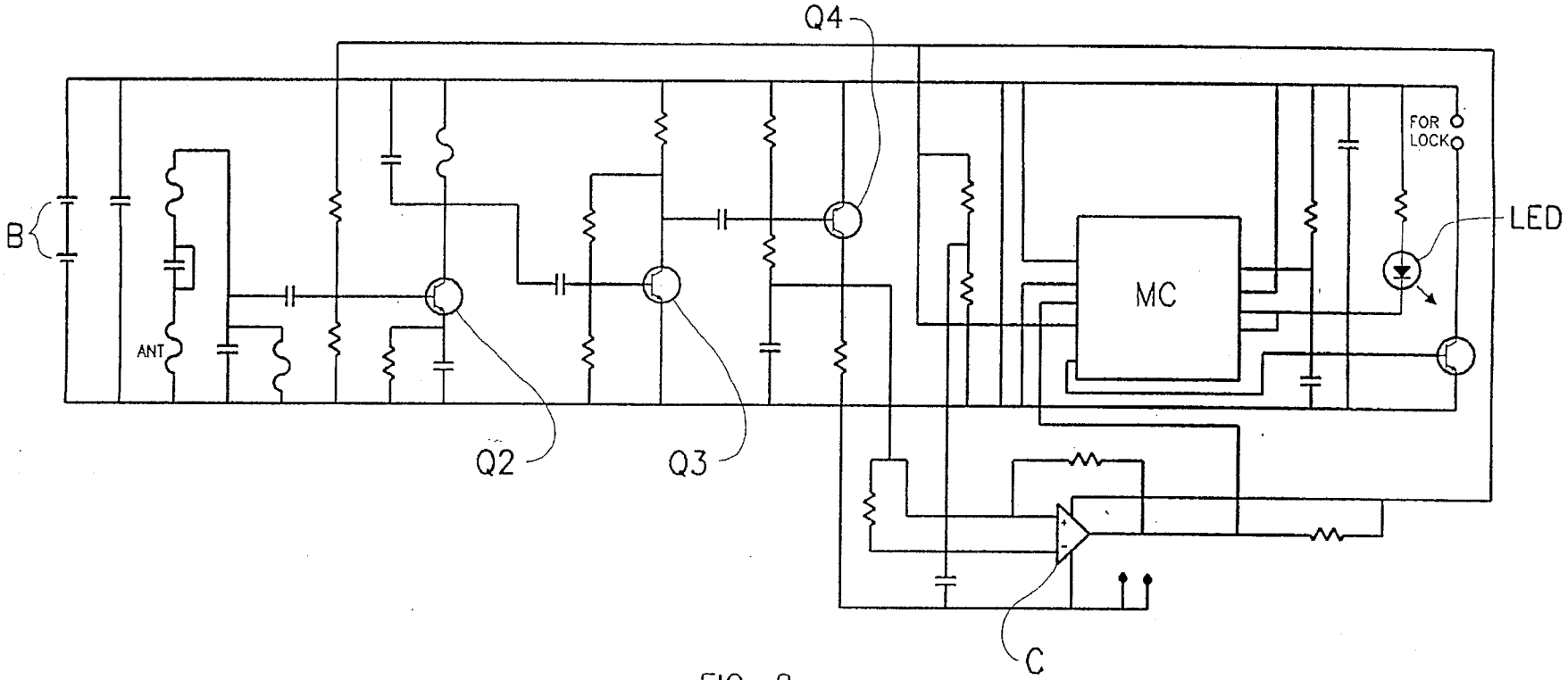
FIG. 8 is an electronic diagram of the receiver of the system.

The receiver illustrated in FIG. 8 is designed to measure any signal pulses received and to look for an "on" pulse width followed by an "off" pulse width that is within these ranges. The signal from a radio transmitter that has a steady signal (as compared to an asymmetric signal) will be ignored as will signals that do not conform to the desired range of asymmetric signals. The design is intended to recognize as valid signals both the pulse train and the coded signals from conventional garage door openers and automotive entry systems since these generally produce asymmetric signals within the desired range.

Figure 9:
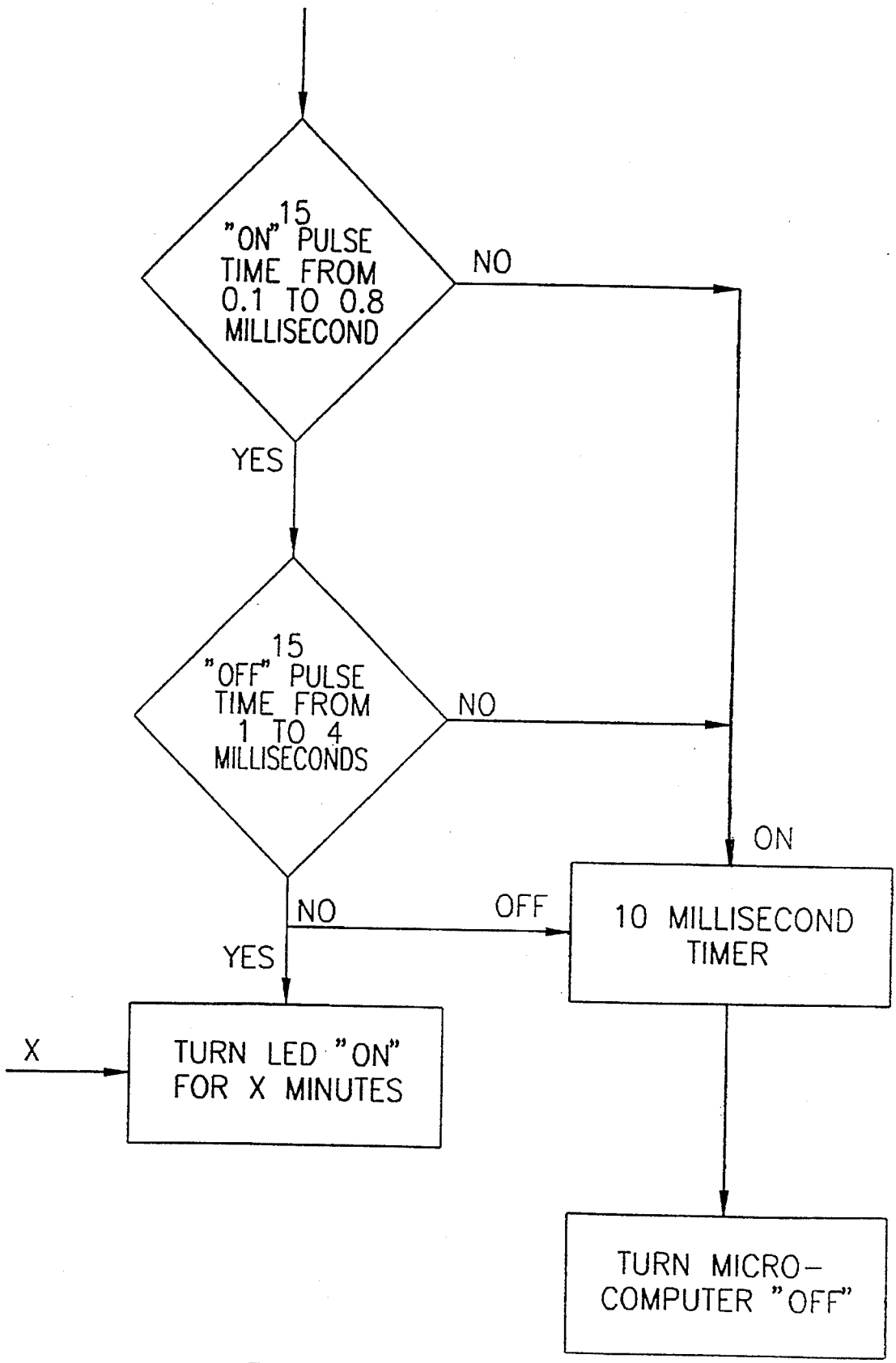
FIG. 9 is a logic diagram illustrating the control algorithm.

Referring to the preferred embodiment of the receiver illustrated in FIG. 8, the circuit is powered by a pair of double or triple A alkaline cells or batteries B. Transistor Q2 and the circuits around it are an RF preamplifier. Transistor Q3 is a demodulator to detect the radio frequency energy when it is present. It is left on all the time at a very low power consumption since it would be difficult to turn it on rapidly enough. Q4 is a low frequency amplifier to increase the level of the detected signal. A comparator C compares the level of the detected signal with a long time average signal to remove the effect of any steady signals such as from a broadcast radio or TV station. The comparator output is fed to an input port pin on a microcomputer MC which is turned on approximately every 100 milliseconds. When the microcomputer turns on it turns on the RF preamplifier and the comparator. After enough time to allow the circuits to settle (approximately 1 millisecond) the microcomputer starts timing the signals at the output of the comparator and determines whether the signals are within the acceptable range, i.e., "on" pulses in the range of 0.1 to 0.8 millisecond and "off" pulses in the range of 1 to 4 milliseconds (FIG. 9). If no signal is detected in 10 milliseconds, the system is turned off again. If the signal is within the acceptable range the microcomputer will turn on the L.E.D. for a selected period of time (x minutes) which is selected to provide enough time for a person to reach and open the door before the light is turned off.

The antenna ANT shown in FIG. 8, may either be an electronic antenna or it may be the lock itself. If the antenna is the lock itself, it may be necessary to isolate the lock from the door and doorway with an insulating plastic sleeve 120 (FIGS. 4 and 5) located between the exterior support assembly and the door and similarly between the interior support assembly and the door. Preferably, the latch bolt assembly (not shown) would then be electrically isolated also.

What is claimed is:

1. A door lock assembly to be secured within a horizontally extending through hole in a door which can have from a minimum to a maximum thickness, comprising an exterior lock assembly including
- a plug having a key receiving opening,
- an exterior rose liner,
- light pipe means for illuminating said key receiving opening including a rod shaped portion secured to said exterior rose liner and extending axially inwardly for receiving light, and
- tubular housing means for receiving said axially extending rod shaped portion,
- said tubular housing means having a length corresponding to the length of said axially extending rod shaped portion, an interior lock assembly including
- an interior rose liner and
- light transmitting means including a light source for transmitting light axially,
- said light transmitting means being supported by said interior rose assembly so that when said door lock assembly is secured within a door having a maximum thickness said light transmitting means will be axially spaced from said rod shaped portion by a distance at least equal to the difference between the minimum and maximum door thickness.

2. A door lock assembly according to claim 1, wherein said exterior lock assembly includes a cylindrical shield, said cylindrical shield including said tubular housing means.

3. A door lock assembly according to claim 1, wherein said light transmitting means further includes lens means for focusing the light emitted by said light source.

* * * * *